US007497548B2

(12) United States Patent
Yamazaki

(10) Patent No.: US 7,497,548 B2
(45) Date of Patent: Mar. 3, 2009

(54) INKJET RECORDING APPARATUS

(75) Inventor: Takeshi Yamazaki, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 295 days.

(21) Appl. No.: 11/370,822

(22) Filed: Mar. 8, 2006

(65) Prior Publication Data

US 2006/0209121 A1 Sep. 21, 2006

(30) Foreign Application Priority Data

Mar. 15, 2005 (JP) ..... 2005-072664

(51) Int. Cl.
*B41J 2/165* (2006.01)

(52) U.S. Cl. ..... 347/29; 347/30; 347/32

(58) Field of Classification Search ..... 347/23, 347/28, 29, 30, 32, 33
See application file for complete search history.

(56) References Cited

U.S. PATENT DOCUMENTS 6,305,778 B1 * 10/2001 Kobayashi et al. ..... 347/30
7,244,012 B2 * 7/2007 Yamada et al. ..... 347/28

* cited by examiner

*Primary Examiner*—Shih-wen Hsieh
(74) *Attorney, Agent, or Firm*—Lucas & Mercanti, LLP

(57) ABSTRACT

The inkjet recording apparatus has a capping device for cleaning the inkjet nozzles. The capping device has an interconnected cell type porous elastic member housed in a recessed area which is connected to suction. During the cleaning operation, the porous elastic member is pressed against the surface of the nozzle such that the porous member is compressed. Suction is then started in the recess area and ink is drawn from the nozzle. By compressing the porous member, the recess area is decreased in size and good negative pressure can be obtained so as to the draw the ink from the nozzle. When the pressure ceases and the porous member is expanded, and ink is drawn from the surface of the nozzle member and soaks into the porous member. Suction is then again started to remove the ink from the recess and from the porous member.

6 Claims, 8 Drawing Sheets

INKJET RECORDING APPARATUS

This application claims priority from Japanese Patent Application No. 2005-072664 filed on Mar. 15, 2005, which are incorporated hereinto by reference.

BACKGROUND

The present invention relates to an inkjet recording apparatus, and in particular, to an inkjet recording apparatus having a capping device to suction ink from a nozzle hole of printing head (hereinafter also called inkjet head) of inkjet recording apparatus.

In the inkjet recording apparatus, due to long period of nonuse, troubles such as clogging caused by increase of a viscosity of ink because of vaporization of moisture from a nozzle hole of the printing head, clogging of a nozzle by stuffing with paper dust and inability of ink ejection due to pressure loss of inner pressure caused by entering of air bubbles from the nozzle, occur. In addition, adhesion of unwanted ink on the surface of nozzle member results in causes to induce deflected ejection of ink and ink ejection failure.

Printing under such condition causes deterioration of outputted image, such as white spot and deep color spot on outputted image. Therefore, maintenance to recover from the status of pressure loss and clogging is needed.

As a maintenance method, there is disclosed a method to recover inability of ejection by covering the surface of nozzle member with a cap on a close contact basis, and by suctioning while the surface of nozzle member and the cap which are on close contact are partially released (for example, refer to Patent document 1).

There is further disclosed a method having a capping device to cover some nozzle holes in a plurality of nozzle holes and a suction device to suction ink from the aforesaid some nozzle holes through the capping device, or having a blocking device to block some nozzle holes in a plurality of nozzle holes and a pressure device to discharge ink from other nozzle holes than blocked nozzle holes (for example, Patent document 2).

(Patent Document 1) Japanese Registration Patent No. 3083409

(Patent Document 2) Japanese Registration Patent No. 2718724

In recent years, in inkjet recording apparatuses, the number of nozzle to eject ink has been increased due to improvement of printing speed. If inability of ejection occurs on these nozzles, it causes deterioration of output image.

In a recovering method according to Patent document 1 wherein a cap suctions to recover inability of ejection, as a recovering device, whole printing head has to be covered to recover only one nozzle in case of a large number of nozzles, resulting in ejection of a large amount of ink, for recovering one nozzle, and thereby, ink is wasted.

Also, due to downsizing of the printing head, the nozzle portion is integrated highly densely and manufacturing of the cap to suit a single nozzle is difficult, which results in a cost increase. Therefore, in actual suctioning is carried out including some neighborhood nozzles in place of a single nozzle. To cope with these problems, a cap covering a part of nozzle is invented in Patent document 2. However, according to the structure in Patent document 2, in case ink remaining at the portion where the cap and printing head contact each other at a rim of nozzle in the course of recovering action in a sequence where the cap is contacted, suctioned, maintained and released, deflective ejection of ink is caused, because of the structure of the cap.

SUMMARY OF THE INVENTION

The invention has been attained, in view of the above circumstances, and an object of the present invention is made to provide an inkjet recording apparatus wherein in a recovering device to recover a nozzle having inability of ejection (non-ejecting nozzle), non-ejecting nozzles can be recovered using small amount of wasted liquid, and deflective ejection of ink caused by adhesion of remaining ink at the rim of nozzle which ink is left by contacting printing head and cap section, is reduced.

The aforesaid object will be attained by the following structures:

an inkjet recording apparatus, including:

a printing head having a plurality of nozzle holes which emit ink; and a capping device to collect ink ejected from the nozzle hole by covering the nozzle hole of the printing head, wherein the capping device has an interconnected cell type porous elastic member to contact with the surface of nozzle member at a peripheral area of the nozzle hole, a recession not to block up the nozzle hole of the printing head, on a surface of porous elastic member which contacts with the surface of nozzle member, a base member to house the porous elastic member, and a suction device communicated to the recession of the porous elastic member to suction ink form the nozzle hole of the printing head.

BRIEF DESCRIPTION OF THE DRAWINGS

Embodiments will now be described, by way of example only, with reference to the accompanying drawings which are meant to be exemplary, not limiting, and wherein like elements are numbered alike in several Figures.

DESCRIPTION OF THE PREFERRED EMBODIMENT

Figure 1:
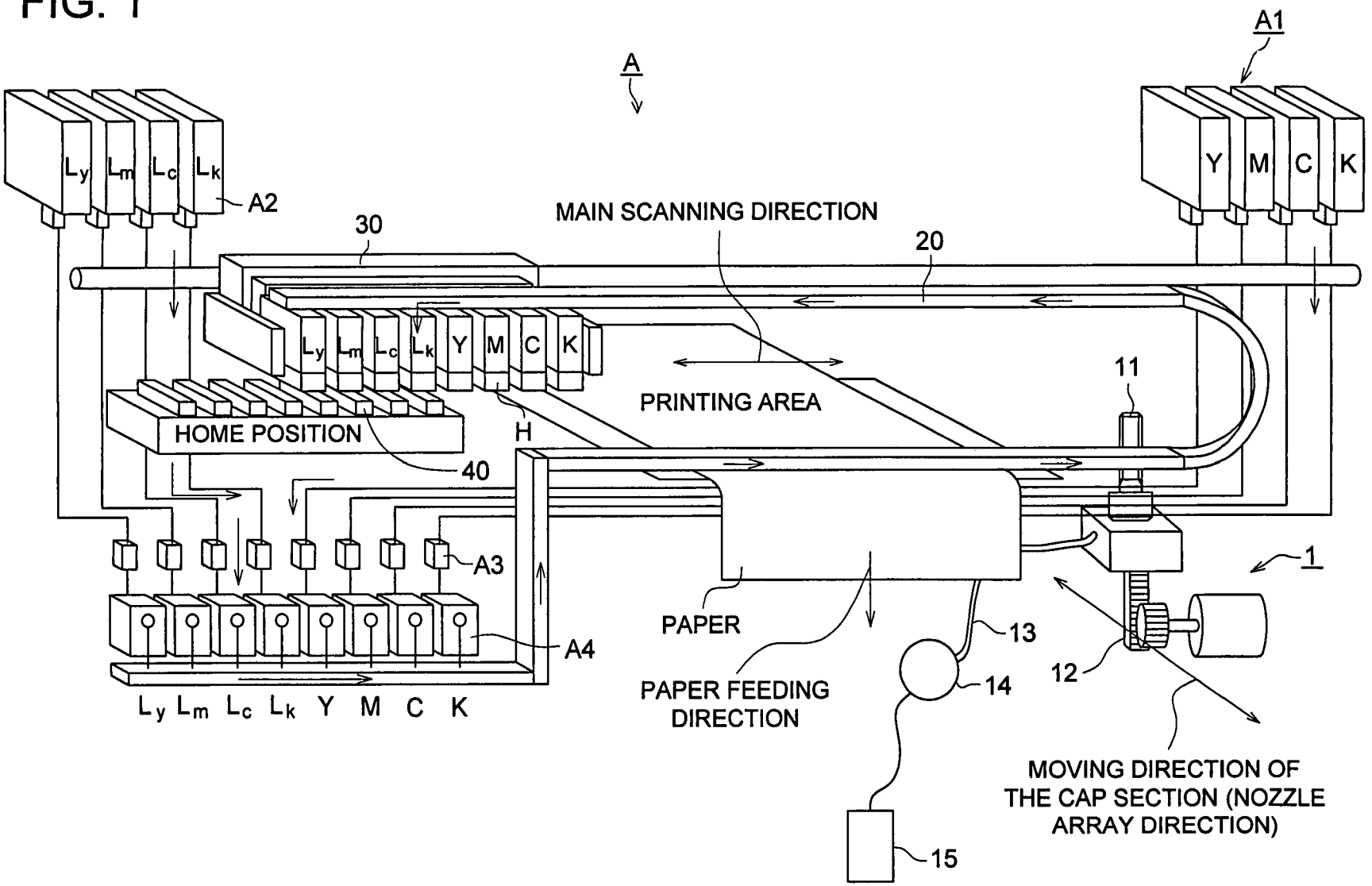
FIG. 1 is a conceptual drawing of an inkjet recording apparatus related to the present invention.

With reference to the drawings, an embodiment of the recovering device and the inkjet recording apparatus of the present invention will be explained as follows:

FIG. 1 is a conceptual drawing of inkjet recording apparatus A related to the present invention. Meanwhile, the inkjet recording apparatus related to the present invention is not limited to what is shown in the embodiment below:

Printing head H is installed on carriage 30. Carriage 30 reciprocates along a main scanning direction so as to reciprocate printing head H along the main scanning direction. In the course of reciprocating movement of the printing head, image recording is implemented, by ejecting ink, and close contacting and releasing with ink suction cap 11 is carried out as described afterward.

Ink is supplied from ink cartridge A1 and A2 to printing head H through ink supply path 20. In the present embodiment, besides ink cartridge A1, ink cartridge A2 having ink whose density is lower than that of ink in ink cartridge A1 is provided to precisely express graduation of images.

Between ink cartridges A1 and A2, and printing head H, supply valve A3 and intermediate tank A4 are provided in this order from the upstream side.

Supply valve A3 is, a valve constructed to open and close electrically as in electromagnetic valve for example, and it adjusts an amount of ink supplied from cartridges A1 and A2 to intermediate tank A4.

Intermediate tank A4 temporarily reserves ink supplied from ink cartridges A1 and A2 to printing head H. The cartridges are replaced when the remaining amount of ink becomes low. Also, by providing the intermediate tank lower than printing head H and by keeping the height of the tank low, negative pressure is generated to maintain an appropriate pressure to eject ink.

Capping device 1 is composed of cap section 11, rack-and-pinion 12 to move cap section 11 up and down to make it contact and release for the surface of nozzle member, an unillustrated cap section moving device to move cap section 11 and rack-and-pinion 12 in a cap moving direction, which is a nozzle array direction, suction device 13 representing a suction tube, suction pump 14 and waste liquid tank 15 in which waste liquid suctioned by suction pump 14 is discharged.

Figure 2:
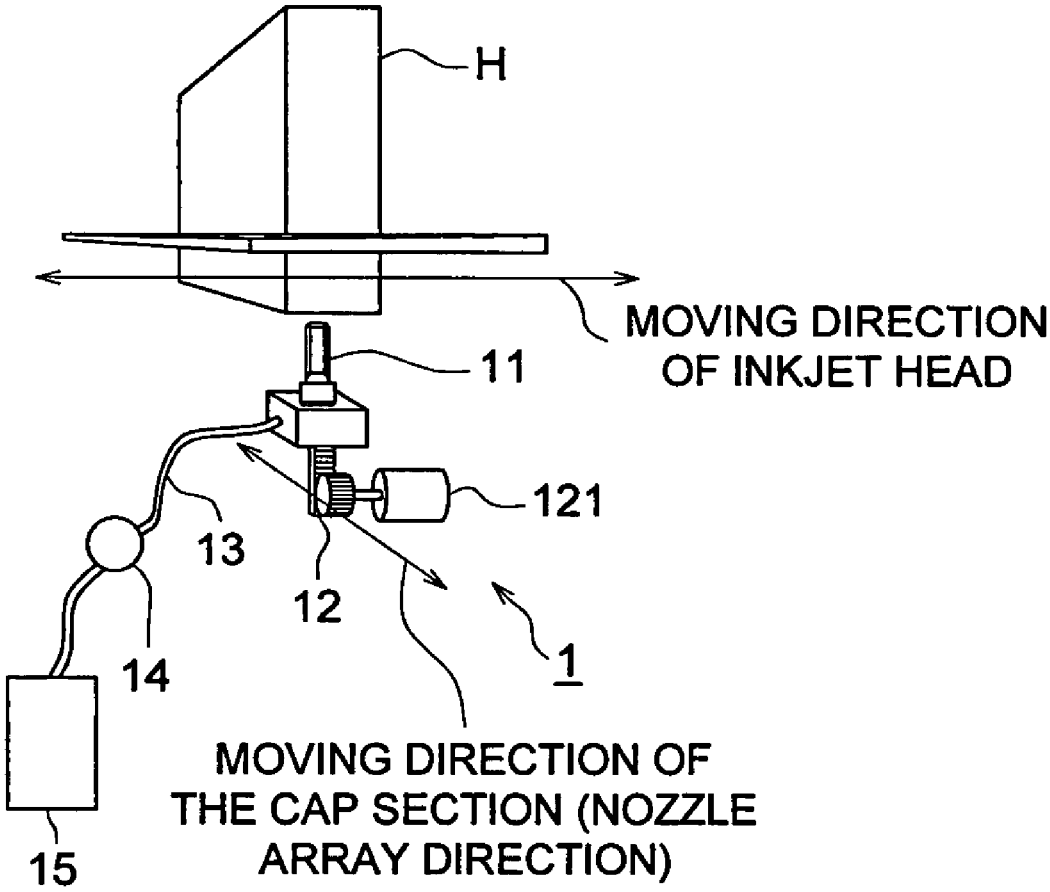
FIG. 2 is a schematic view of the capping device.

In capping device 1, as shown in FIG. 2, to control the portion where suction is needed to appropriate position, for the nozzle array direction of printing head H, the cap section is moved by an unillustrated cap moving device and for a direction perpendicular to the nozzle array direction, in other word main scanning direction, printing head H scans in a carriage direction. When a portion where suction is needed comes to an appropriate position, cap section 11 moves up and down through rack-and-pinion 12, thereby cap section 11 and the surface of nozzle member are contacted and released to carry out suction-recovering action.

Next, a structure of the capping device related to the present invention is explained.

Figure 3:
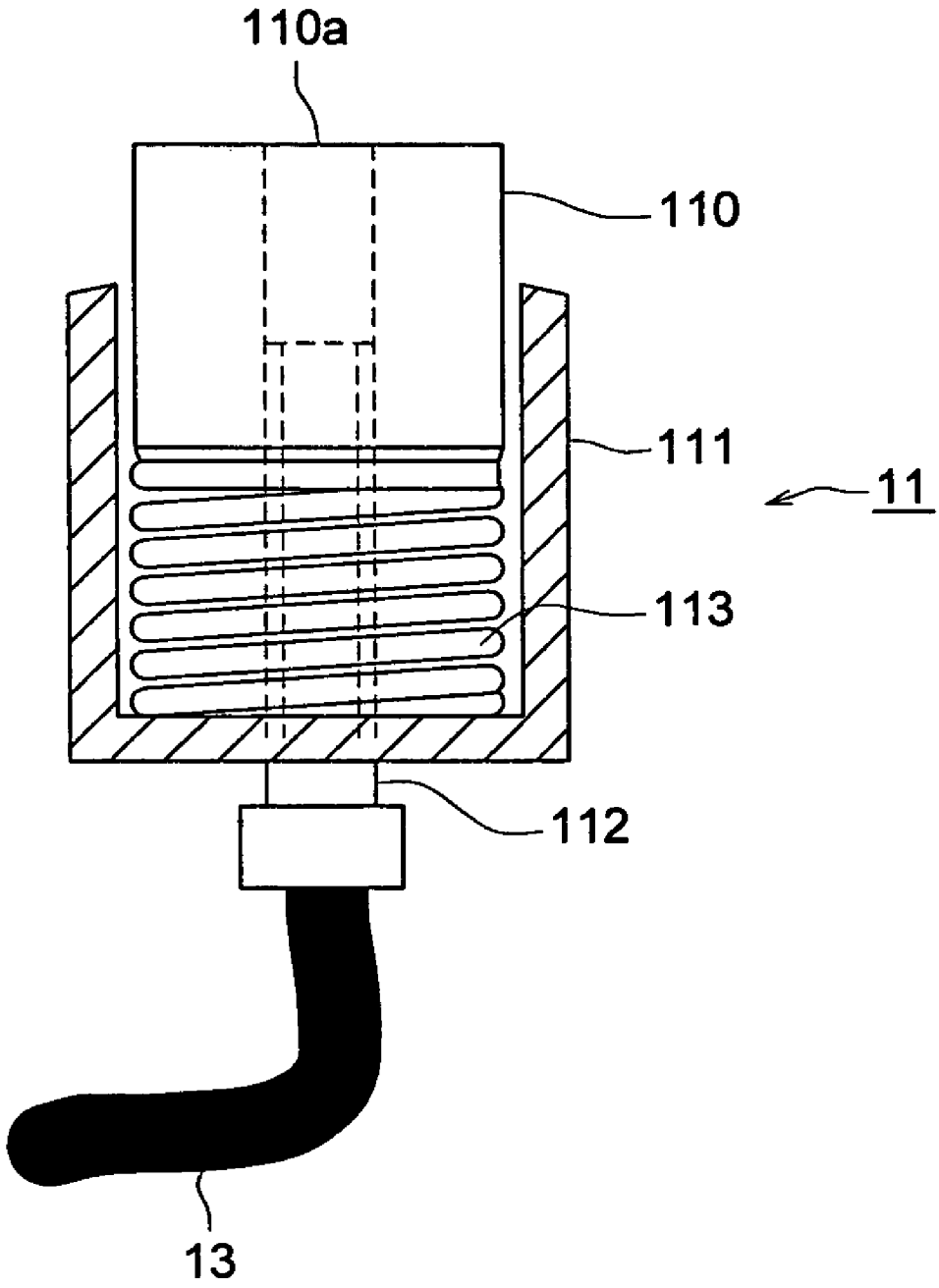
FIG. 3 is a structural view of the cap section.

FIG. 3 is a structural drawing of a cap section related to the present invention. Cap section 11 is composed of porous elastic member 110 formed by interconnected cell type sponge having recessed area 110*a*, supporting member 112 having hollow structure to house porous elastic member 110, spring 113 representing an urging member and base member 111 having a shape to cover a part of side surface and bottom surface of porous elastic member, spring 113 and supporting member 112.

The porous elastic member and hollow section of supporting member are communicated and connected to section tube 13.

While the interconnected cell type sponge to form the porous elastic member is not limited, for example, Rubycell made of polyurethane of Toyo Polymer Co., Ltd. and PVA (poly vinyl alcohol) can be used.

Figure 4:
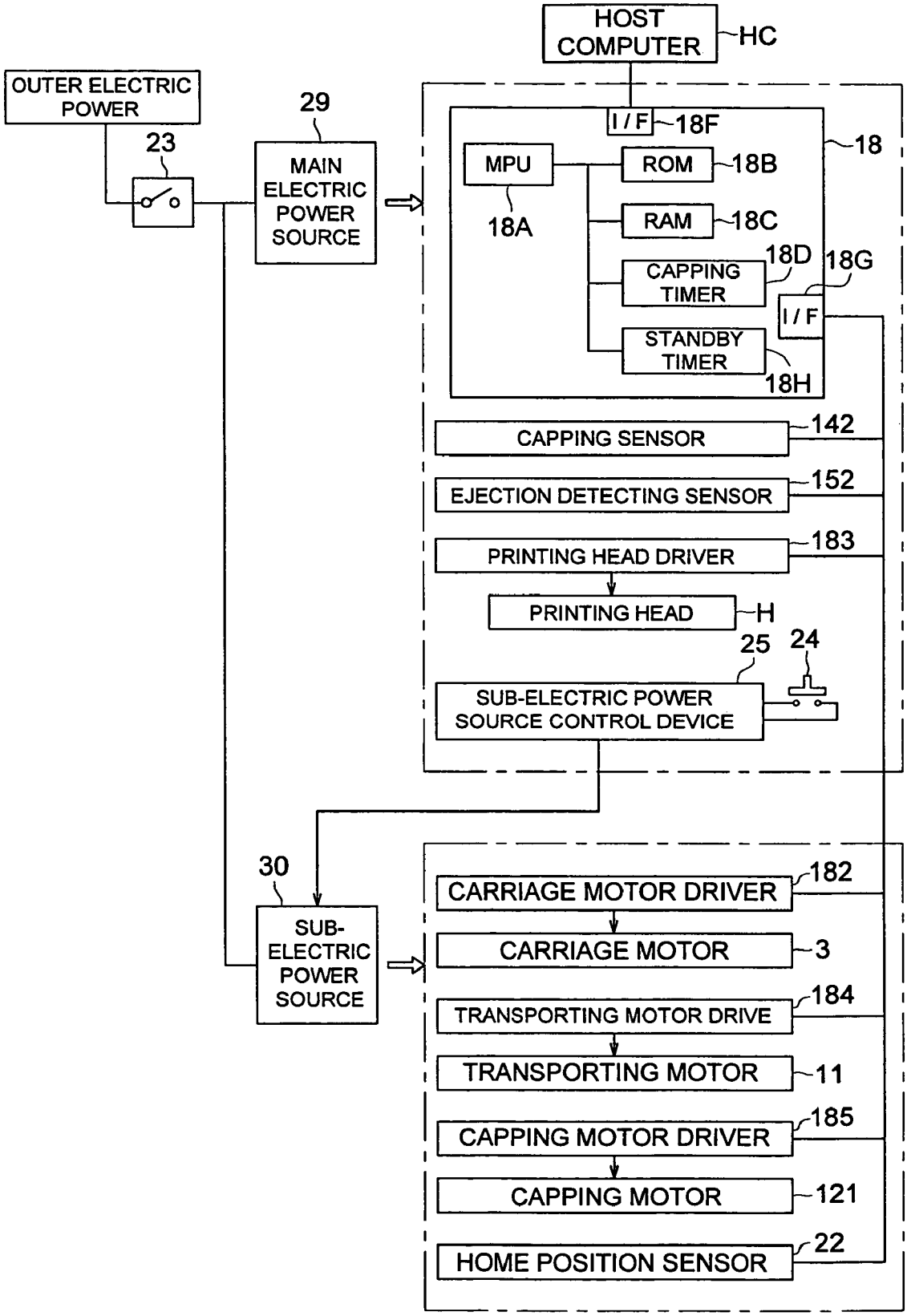
FIG. 4 is a block diagram of control of inkjet recording apparatus related to the present invention.

The functional structure of inkjet recording apparatus related to the present invention is explained with using FIG. 4. FIG. 4 is a block diagram showing functional structure of inkjet recording apparatus A related to the present invention. Meanwhile, like structural factors shown in FIG. 1 to FIG. 3 are numbered alike.

Control device 18 is composed of MPU 18A containing micro processor to implement various kinds of control sequences, ROM 18B to store data and control sequences, RAM 18C to temporally store various kinds of data, capping timer 18D having timer function and standby timer 18H to measure standby time.

Further, control device 18 has interface 18F to receive image data transferred from upper level host computer HC and interface 18G to send out control signals to printing head driver 183 to drive printing head H.

Through various kinds of signals of control device 18, carriage motor driver 182, ejection driving device (printing head driver) 183, transport motor driver 184 and capping motor driver 185 drive carriage motor 3, printing head H, transport motor 11 and capping motor 121 respectively.

Also, detection signals of home position sensor 22, capping motor sensor 142, ejection detecting sensor 152 are received by control device 18 through interface 18G.

The numeral 23 represents a switch to supply outer electric power (AC 100V in the present embodiment) to inkjet recording apparatus A to crate an operation status.

The numeral 24 represents sub-power switch 24, and it is constructed to repeat turning on and off an output of sub-electric power source device 30 through sub-power source control device 25 provided in control device 18 by pressing sub-power switch 24 repeatedly while main switch 23 is turned on.

Sub-electric power source 30 is supplied electric power from an outer electric power source through main power switch 23 and is controlled to be turned on and off by a control signal of sub-electric power control device 25. Sub-electric power source 30 supplies electric power to the capping device in which devices (members) supplied electric power directly from main electric power device 29 are excepted and other controlled devices i.e. carriage motor driver 182, transport motor driver 184, capping motor driver 185, home position sensor 22 and capping motor 121 to contact and release the cap section 11 against the surface of nozzle member or to a display device having a liquid crystal panel to display printing data and error data.

In the above structures, by tuning on main power switch 23, electric power is supplied from the outer electric power source to main electric power device 29 and sub-electric device 30, and then inkjet recording apparatus A becomes standby status for printing.

In this status, an image data from host computer HC is received by control device 18 through interface 18F, then after image processing of the received image data, it is converted to a control signal in accordance with a control sequence stored in ROM18B, then the converted control signal drives printing head driver 182 through interface 18G to carry out various kinds of actions including printing operation.

An operation of inkjet recording apparatus related to the present invention is explained.

Figure 8:
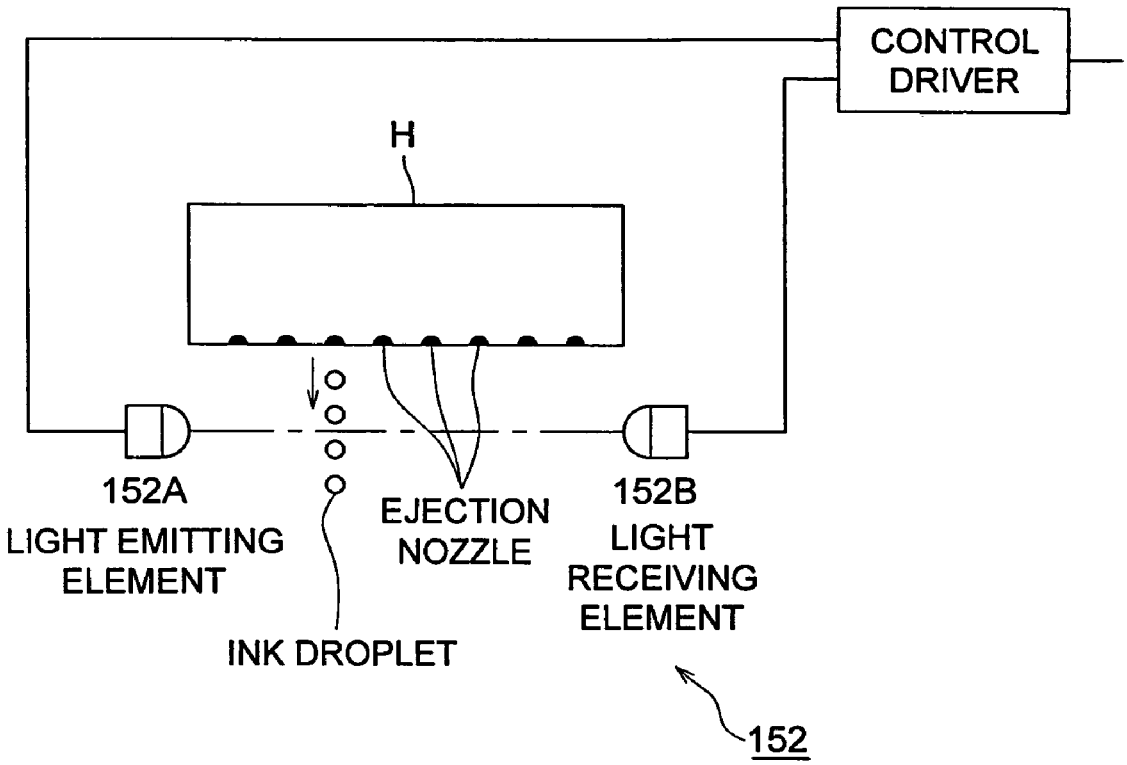
FIG. 8 is a conceptual drawing showing an example of ink ejection sensor.

FIG. 8 is a conceptual drawing showing an example of ink ejection sensor to detect non-ejecting nozzle.

Ink ejection sensor 152 is composed of light emitting element 152A and light receiving element 152B which are provided at both ends of an array of ink ejecting nozzles. Light emitting element 152A and light receiving element 152B are provided in the same straight line that is in the direction of the nozzle array and the light emitted from light emitting element 152A is to be received by light receiving element 152B. If ink is emitted from a nozzle hole normally, the light beam emitted from light emitting element 152A is temporarily interrupted by ink and is not received by light receiving element 152B so that the ink ejection sensor 152 detects that the nozzle hole emits ink normally. On the other hand, if ink is not emitted from a nozzle hole, the light bean emitted from light emitting element 152A is not interrupted by ink and is received by light receiving element 152B so that ink ejection sensor detect that the nozzle hole does not emit ink.

Figure 5:
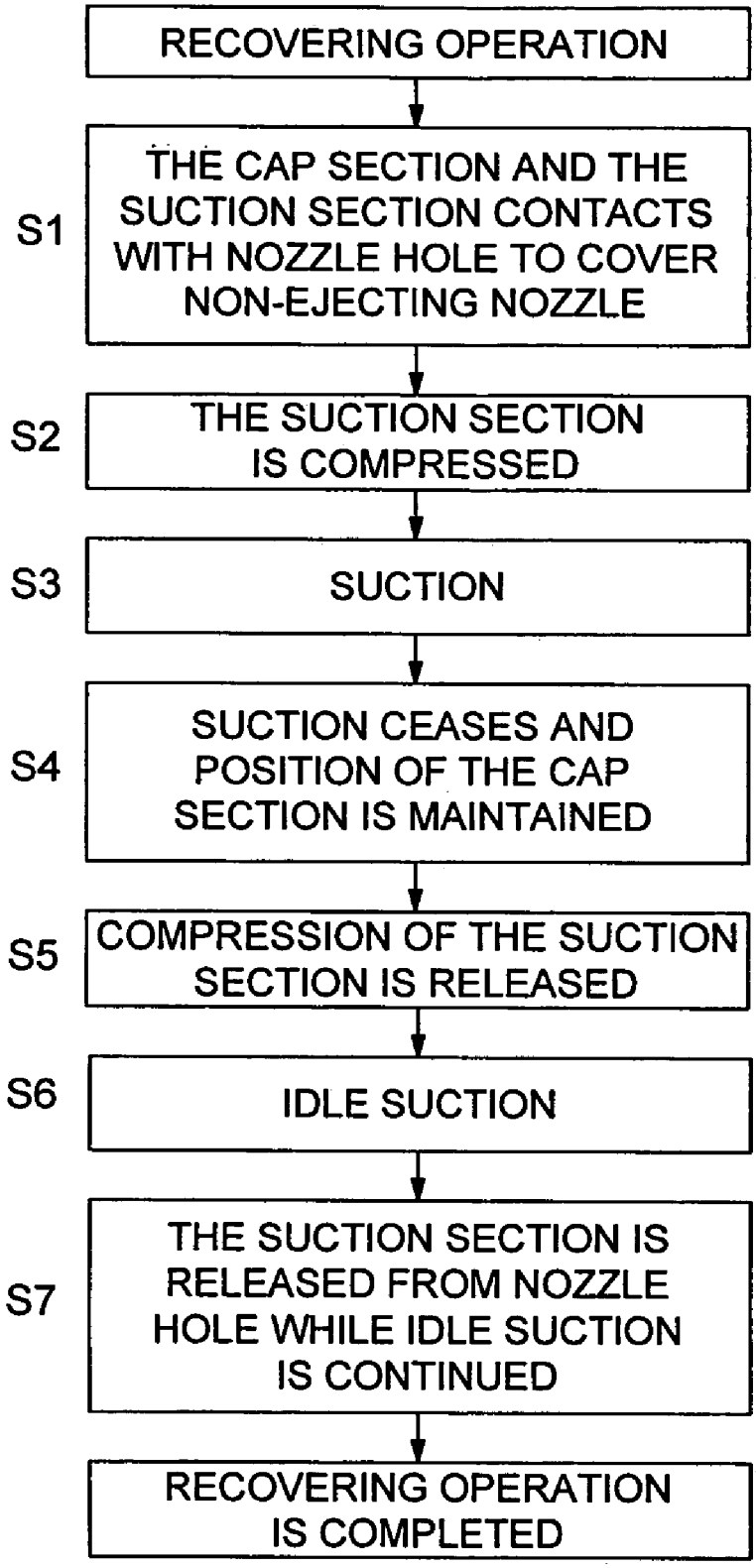
FIG. 5 is a flow chart indicating a sequence of recovering action.
Figure 6A:
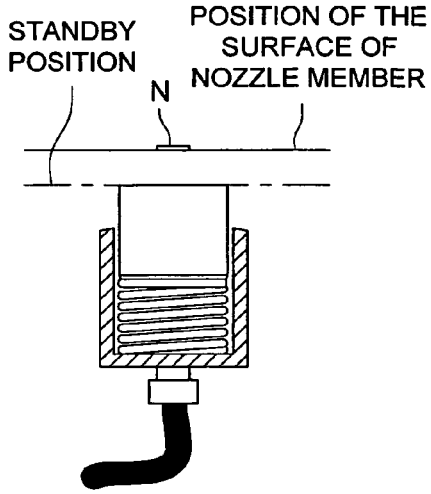
FIG. 6(*a*) to FIG. 6(*e*) are the drawings each indicating a relationship between status of the cap section and ejection surface position in the course of recovering action.
Figure 6B:
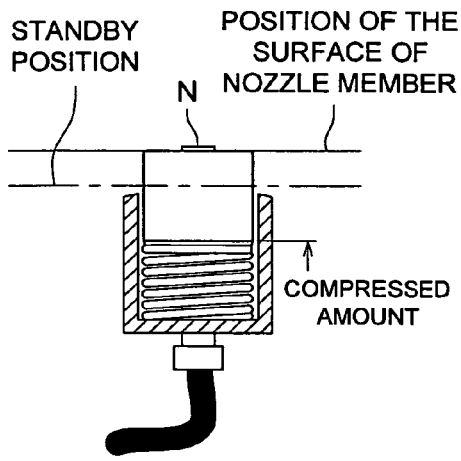
Figure 6C:
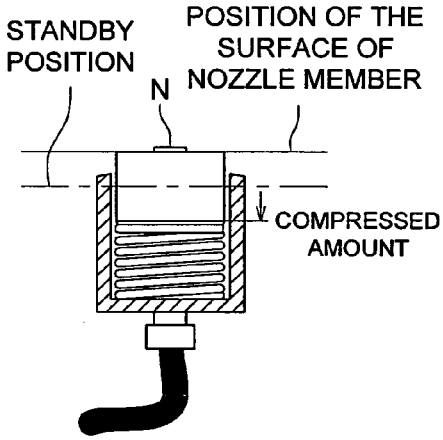
Figure 6D:
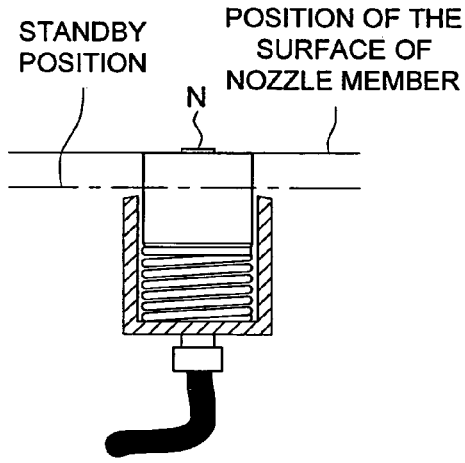
Figure 6E:
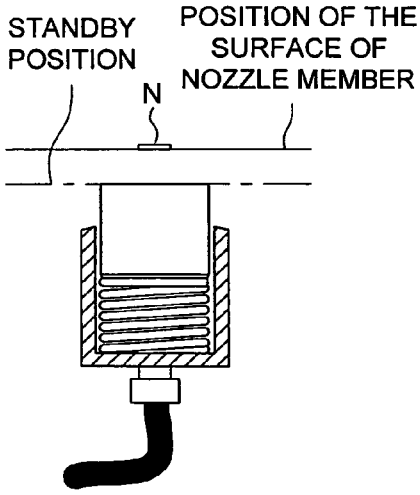

FIG. 5 is a flow chart showing a sequence of recovering action executed in the inkjet recording apparatus. FIG. 6 is a drawing showing each status of the cap section related to the position of the surface of nozzle member in each process.

(Operation Sequence)

Step S1: Cap section 11 aligned to non ejecting nozzle position moves upward through rack-and-pinion 12 then the porous elastic member of cap section 11 contacts the surface of nozzle member to cover the non ejecting nozzle N (FIG. 6 (*b*)).

Step S2: Cap section 11 in contact is further moved upward to compress the porous elastic member (FIG. 6 (*c*)).

Step S3: After compressing porous elastic member in step 2, suction operation is carried out to create a negative pressure in the recess. By compressing the porous elastic member in step 2, density of the porous elastic member increases so that the appropriate vacuum pressure (negative pressure) can be maintained in the recessed area by operating suction pump.

Step S4: After ceasing suction operation, the status of the cap section 11 is maintained and the negative pressure in the porous elastic member becomes close to the atmosphere pressure by coming out of ink from the nozzle.

Step S5: Cap section 11 is lowered by the rack-and-pinion to release compression of the porous elastic member in the status where the porous elastic member is in contact with the surface of nozzle member through the spring (FIG. 6 (*d*))

Step S6: Idle suction is carried out in the status of step 5 to suction ink in the recessed area and ink soaked by porous elastic member.

Step S7: In the status where idle suctioning is continued, the porous elastic member is released from the surface of nozzle member at a velocity not greater than a predetermined velocity (FIG. 6(*e*)). The predetermined velocity means a velocity where ink droplets on the surface of nozzle member can be Soaked by the porous elastic member without being cut off on the way releasing.

Meanwhile, in the present embodiment, the printing head for a shuttle type inkjet recording apparatus is quoted, however the present invention can also be applied to a line head and a multi head for line type inkjet recording apparatus.

Figure 7:
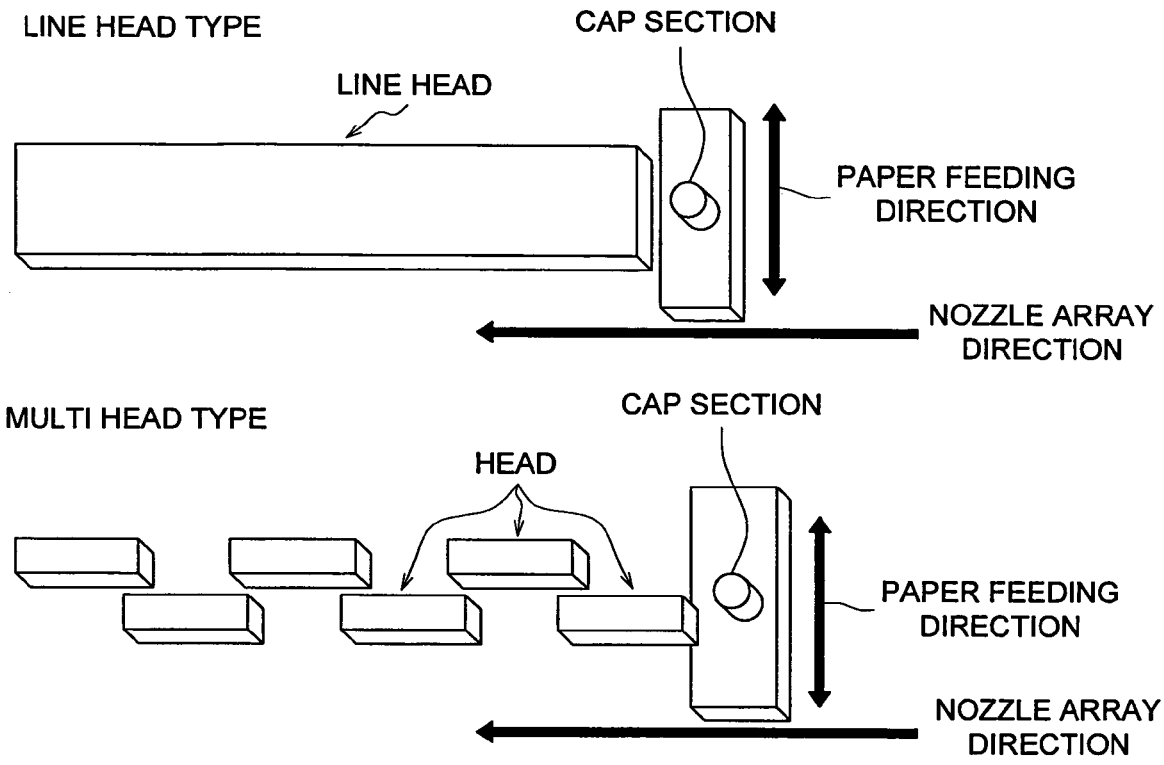
FIG. 7 is a schematic diagram wherein a recovering apparatus related to the present invention is applied to a line type inkjet recording apparatus.

FIG. 7 is a schematic drawing where the recovering device related to the present invention is applied to a line head and to a multi head in which heads are allocated in a plurality of lines of line type inkjet recording apparatus. For both line head type and multi head type, the cap section is able to move in the directions of paper feeding and nozzle array through an unillustrated moving device and the cap section moves to a non-ejecting nozzle position to implement recovering action. In case the recovering device related to the present invention is applied to line type and multi type head, waste liquid is reduced so that the effect is greater.

As described above, the cap section, the suctioning device and the recovering operation sequence related to the present invention realize a recovering method wherein the amount of waste liquid in the course of recovering non-ejecting nozzle is decreased and deflective ejection due to the remaining ink at peripheral of nozzles caused by contact between the porous elastic member of the cap section and the surface of nozzle member is reduced.

In the above structure, by contacting an intercommunicating cell type sponge having recessed area so that the recessed area meets the nozzle hole, ink can be suctioned from the nozzle hole. Also in the above structure, by closely contacting and compressing the porous elastic member so that the recessed area meets the nozzle hole, suction of ink from peripheral of the recessed area of the porous-elastic member is prevented, thereby suction force can be concentrated to the suction from the nozzle hole.

In the above structure, by covering only specific non-ejecting nozzle hole in a plurality of nozzle holes and its neighborhood, and by suctioning ink from the specific nozzle hole and its neighborhood, suctioning from unnecessary nozzle holes is prevented and amount of waste liquid can be reduced.

In the above structure, suctioning force can be concentrated to a nozzle hole and the non-ejecting nozzle can be recovered through simple control.

In the above structure, by suctioning ink through the suctioning device as compression of suction section is released, while the suction section, configured with porous elastic member 110 and spring 113, is in contact with ejection surface, and by releasing the porous elastic member from the surface of nozzle member through the moving device, ink adhered on the surface of nozzle member can be absorbed by the porous elastic member and ink absorbed by the porous elastic member can be discharged from the porous elastic member through the suction device, thereby decreasing of absorbing force of the porous elastic member can be prevented.

The above structure makes it possible to provide, an inkjet recording apparatus wherein suction recovering of non-ejecting nozzle and removable of ink adhering on the surface of nozzle member can be done through a subsequent action in a short time with simple control and efficient recovering action of non-ejecting nozzle is carried out.

EXAMPLE OF EMBODIMENT

While the present invention is explained referring to an example of embodiment, the present invention is not limited to the embodiment thereof.

Using an inkjet recording apparatus shown in FIG. 1, an evaluation of the cap section, the suction device and the recovering sequence concerning non-ejecting nozzle is carried out. In the evaluation, an image is actually printed and existence of white spot and dark spot in the outputted image is observed visually.

<Conditions of Evaluation>

1. Porous elastic member: Polyurethane interconnected cell (pore) elastic member (Rubycell: manufactured by Toyo polymer Co., Ltd.) pore diameter: 5-7 μm, pore rate: 80%, density: 0.22 g/cm$^3$
2. Suction pressure at suction: 30 kPa
3. Time to compress and suction the porous elastic member: approx. 5 sec.
4. Time to maintain the porous elastic member in compressed condition while suctioning is stopped: approx. 5 sec.
5. Idle suction time: approx. 20 sec.
6. Velocity to release the porous elastic member from the surface of nozzle member: 0.4 mm/sec Under the above conditions, 20 cycles of recovering actions of non-ejecting nozzle were carried out. While actual printing was carried out and existence of occurrence of white spot and dark spot was evaluated visually per each reciprocating recovering operation, no occurrence was identified and recovery of non-ejecting nozzle and removing the remaining ink on the surface of nozzle member were excellent.

What is claimed is:

1. An inkjet recording apparatus, comprising:

a printing head having a nozzle member comprising a plurality of nozzle holes which emit ink; and a capping device to collect ink ejected from the nozzle hole by covering the nozzle hole, comprising:

an interconnected cell type porous elastic member to contact with a surface of the nozzle member at a peripheral area of the nozzle hole, a recessed area not to block up the nozzle hole of the printing head on a surface of the porous elastic member which contacts with the surface of the nozzle member, a base member to house the porous elastic member, and a suction device communicated to the recessed area of the porous elastic member to suction ink from the nozzle hole, wherein the suction device suctions the ink from the nozzle and from the porous elastic member which soaks the ink on the surface of the nozzle member when the porous elastic member is in contact with the surface of the nozzle member.

2. An inkjet recording apparatus of claim 1, wherein an urging device supported by a base member urges the porous elastic member to the surface of the nozzle member.

3. An inkjet recording apparatus of claim 1, wherein the porous elastic member covers a vicinity of a nozzle hole with centering around the nozzle hole.

4. An inkjet recording apparatus of claim 1, wherein a moving device supporting the base member moves the capping device, and a control device controls the moving device so that the porous elastic member contacts with the surface of the nozzle member and is urged to the surface of the nozzle member and compressed, and controls the suction device to suction ink from the nozzle hole while the porous elastic member is compressed.

5. An inkjet recording apparatus of claim 4, wherein the control device controls the suction device to suction ink as compression of the porous elastic member is released with maintaining contact between the porous elastic member and the surface of the nozzle member, and controls the moving device to release the porous elastic member from the surface of the nozzle member as ink is suctioned.

6. An inkjet recording apparatus of claim 1, wherein an urging device supported by a base member urges the porous elastic member to the surface of the nozzle member, the porous elastic member covers a vicinity of a nozzle hole with centering around the nozzle hole, and a control device controls the moving device so that the porous elastic member contacts with the surface of the nozzle member, and is urged to the surface of the nozzle member to be compressed, and controls the suction device to suction ink from the nozzle hole while the porous elastic member is compressed, then stops suctioning for a predetermined period with maintaining a status of compression of the porous elastic member, and then controls the suction device to suction ink as compression of the porous elastic member is released with maintaining contact between the porous elastic member and the surface of the nozzle member, and controls the moving device to release the porous elastic member from the surface of the nozzle member as ink is suctioned.

* * * * *